United States Patent [19]

Corbière

[11] 3,958,406

[45] May 25, 1976

[54] YARN HAVING A BASIS OF POLYESTER WITH IRREGULAR TITER

[75] Inventor: Claude Corbière, Riorges, France

[73] Assignée: Rhone-Poulenc-Textile, Paris, France

[22] Filed: Nov. 29, 1971

[21] Appl. No.: 203,064

[30] Foreign Application Priority Data

Dec. 1, 1970 France ..... 70.43429

[52] U.S. Cl. ..... 57/140 J

[51] Int. Cl.[2] ..... D02G 3/34

[58] Field of Search..... 57/140 J; 161/179, 181; 264/167, 168

[56] References Cited

UNITED STATES PATENTS

| | | | |
|---|---|---|---|
| 2,004,139 | 6/1935 | Taylor | 57/157 S |
| 2,064,279 | 12/1936 | Taylor et al. | 57/157 S |
| 2,278,888 | 4/1942 | Lewis | 57/140 J |
| 2,296,394 | 9/1942 | Meloon | 57/140 J |
| 2,465,319 | 3/1949 | Whinfield et al. | 161/172 X |
| 2,917,779 | 12/1959 | Kurzke et al. | 57/140 J |
| 2,931,091 | 4/1960 | Breen | 28/72.17 X |
| 2,953,427 | 9/1960 | Egger | 57/140 J |
| 2,975,474 | 3/1961 | Smith | 57/140 J |
| 3,117,173 | 1/1964 | Adams | 57/140 J |
| 3,127,915 | 4/1964 | Bottomley | 57/140 J |
| 3,212,158 | 10/1965 | Kasey, Jr. | 57/140 J X |
| 3,439,084 | 4/1969 | Ono et al. | 161/179 X |
| 3,439,489 | 4/1969 | Holton et al. | 57/140 J |
| 3,587,221 | 6/1971 | Buzano | 57/140 J |

*Primary Examiner*—Richard C. Queisser
*Assistant Examiner*—Charles Gorenstein
*Attorney, Agent, or Firm*—Cushman, Darby & Cushman

[57] ABSTRACT

Fancy polyester based yarns are disclosed, wherein polybutylene terephthalate yarns comprise one or more filaments having irregular diameters, substantially constant crystallinity over the whole length of the filament, and a Young's modulus of less than 300 g/tex. These yarns are useful in textile applications wherein great pliability is required, such as for imitation silk fabrics, dress trimmings, and furniture fabrics.

2 Claims, No Drawings

YARN HAVING A BASIS OF POLYESTER WITH IRREGULAR TITER

BACKGROUND OF THE INVENTION

Canadian Patent Number 782,203 discloses apparatus for irregular stretching yarns. The apparatus consists of a rotating wheel with an eccentrically mounted pin thereon. The pin engages the yarn during the travel of the yarn over the wheel, and lengthens and shortens the path of travel of the yarn during wheel rotation.

French Patent Number 1546531, corresponding to United States patent application Ser. No. 739,519 now U.S. Pat. No. 3,611,521 discloses apparatus generally similar to the above Canadian patent but with a particular type of yarn engaging pin so arranged that the yarn is subjected to sudden disengagement from the pin.

Polybutylene terephthalate polymers are known to the art. See, for example, U.S. Pat. No. 2,465,319, the disclosure of which is hereby included by reference to the extent necessary to understand the polybutylene terephthalate polymers disclosed therein and the processes for making same. French patent 2026544 discloses paint brush bristles made of polybutylene terephthalate which unlike polyethylene terephthalate, can be worked into filaments, branched, and pointed to form satisfactory paint brush bristles.

Yarns having irregular diameters are highly desired in the production of fancy textile articles as they impart a particular desired appearance. Slubbed or knop yarns may be mentioned among irregular diameter yarns which produce fancy effects. Such yarns may be produced by certain twisting operations, or by assembling the yarns in certain manners.

Some processes have been developed to produce irregular diameter, single or multi-filament, synthetic yarns, with such process generally involving modifications of the spinning or drawing processes.

Irregular diameter polyamide yarns that are produced by the art cannot be used for certain important applications, such as for dress trimmings, because of low resistance to light. This low light resistance of polyamide yarns is characterized, among other things, by yellowing and chemical degradation of the mechanical properties. Polyester yarns, especially polyethylene terephthalate, have good photochemical degradation resistance and are suited for certain applications, in particular for the production of irregular diameter yarns whose crystallinities differ in the thick portions and the thin portions, whereby appreciable differences in color intensity are obtained when such yarn is dyed. However, such polyester yarns exhibit a major drawback in that after thermal treatments, such as dying and/or steaming, the yarn will have a harsh feel, which is undesired for most textile applications, because of differences of orientation which are characterized by isotropic crystallization in the thick portions, which also have mediocre mechanical properties. Polyethylene terephthalate yarns have an average Young's modulus, or modulus of elasticity, in the order of 900 to 1400 g/tex.

SUMMARY OF THE INVENTION

The present invention is directed to polyester yarns which consist essentially of one or more filaments or oriented polybutylene terephthalate. The filaments are of irregular diameter, with the portions having the largest diameter being of at least 20% greater diameter than the thinest portions. The filaments have substantially constant crystallinity over their whole length and have an average Young's modulus of less than 300 g/tex.

DESCRIPTION OF THE INVENTION

Single or multi-filament polyester yarns made of oriented polybutylene terephthalate which have an irregular diameter are much superior to similar yarns made of polyethylene terephthalate. The polybutylene terephthalate yarns have substantially constant crystallinity over the whole length of the polybutylene terephthalate filament, unlike filaments of polyethylene terephthalate. These filaments of polybutylene terephthalate have a low Young's modulus or modulus of elasticity, for example, the average Young's modulus is below 300 g/tex.

Because the polybutylene terephthalate filaments have substantially constant crystallinity over their entire length, yarns made of such filaments may be subjected to thermal treatments, such as dying and steaming, without any damage, whereas, as mentioned above, polyethylene terephthalate yarns turn rough and brittle after such thermal treatment. The modulus of elasticity of the polybutylene terephthalate yarns is much lower than the modulus of elasticity of polyethylene terephthalate yarns.

The crystallinity and orientation characteristics of yarn filaments of irregular diameters can be demonstrated by measurements of density and birefringence of the thick and thin portions of the filaments, respectively. It can thereby be illustrated that the polybutylene terephthalate yarns of irregular diameters, in contrast to similar polyethylene terephthalate yarns, have substantially constant crystallinity over the entire length, and birefringences that vary in a predictable manner, varying with the differences of degree of the drawing of the thick portions and the thin portions.

When the present specification refers to yarns of single filaments or multifilaments of irregular diameter, reference is made to single filaments of a diameter or titer which may vary by 1 to 5 or more, even up to 20 or 30 dtex, as well as yarns containing a plurality of such filaments. The overall titer of the yarn may be influenced by manipulation of either the number of individual strands or the titer of individual strands, with the strand titer depending upon the ultimate use of the yarn.

The spacing between the thick portions of a filament is variable and depends upon the particular fancy effect desired. Generally it is preferred that the thick portions be irregularly spaced to avoid the appearance of regular patterns in the finished textile produced. The spacing of the thick portions of the filament may conveniently vary from 1 to 5 meters, although greater or lesser spacing, may be used as desired.

The length of the thick portion of the polybutylene terephthalate filament is also quite variable. Generally, the thick portion will be of a length of 2 or 3 mm up to about 150 cm, but may be even longer, according to the desired appearance of the textile product which is to be prepared from the yarn.

The differences in yarn diameter between the thick portions and the thin portions is also variable; however, it is generally preferred that the thick portion be of at least 20% greater diameter than the thin portion and generally no more than 50% greater diameter than the thin portion. If the thick portion is of less than 20% greater diameter than the thin portion, the marked fancy effect will generally be diminished or lacking, whereas if the thick portions are more than 50% greater in diameter than the thin portions, the thin portions will generally exhibit insufficient mechanical properties. The transitions between the thick portions and thin portions are generally rather gradual and the thick portions themselves may exhibit some variance in yarn diameter.

The yarn filaments of the present invention are substantially of polybutylene terephthalate. However, the use of a polybutylene terephthalate copolymer containing minor amounts, for example, up to 10 or 20 mole %, of another monomer, such as ethylene glycol or propylene glycol, isophthalic acid or 5-sulfoisophthalic acid, and the like, is within the scope of the present invention. It is also possible to use minor amounts of other filaments, at most 20% of such other filaments, with the above polybutylene terephthalate filaments to make a fancy effect yarn. However, it is strongly preferred that no other filaments other than those of polybutylene terephthalate be used in the yarn.

The polybutylene terephthalate yarns of the present invention, which have irregular filament diameters, produce textile articles that are very pliable, with soft feel and fancy appearance even after thermal treatments. These yarns are particularly suitable for applications wherein the fancy effects of irregular diameter yarns is desired, such as for dress trimmings, imitation silks, furniture fabrics and the like. The irregular diameter of single or multifilament polybutylene terephthalate yarns of the present invention is obtained by subjecting at least one polybutylene terephthalate filament to an irregular drawing step, which step can be conducted by various methods that are known to those in the art.

After the filaments have been conventionally melt extruded it is generally preferred to subject them to a slight preorientation by adjustment of the winding speed and the spinning speed. The filaments that are so preoriented are then subjected to an irregular drawing step, which may be of the type described in French patent 1,546,531 or other processes known in the art that are used to modify the yarn drawing. In any of these irregular drawing processes the apparatus should be so arranged as to produce a randomized effect to avoid regular spacing of the thick portions, which could lead to an undesired regular patterning of the finished article.

EXAMPLES OF THE INVENTION

The invention will be understood more clearly with reference to the following examples which illustrate but do not limit the invention.

The dynamic measurements of the yarns produced in the examples below were done on an Instron model TM dynamometer, using filaments 5 cm long and an average rupture time of 25 seconds.

Young's modulus, or the modulus of elasticity, is calculated as the value of the slope of the first linear part of the dynamometric curve, starting after secondary effect disturbances have disappeared.

The crystallinity of differing portions of the yarn is deduced from the yarn density. The density ($d_{ech}$) of the yarn portion in question is determined. The degree of crystallization expressed in percentage is calculated by the formula:

$$K_a = \frac{d_{ech} - d_a}{d_c - d_a} \times 100$$

wherein $d_a$ is the density of the amorphous polymer, being 1.2765 for polybutylene terephthalate in the amorphous state, and $d_c$ is the density of the crystallized polymer, being 1.367 for polybutylene terephthalate in the completely crystallized state.

Example 1

A molten polybutylene terephthalate polymer, produced according to Example 13 of U.S. Pat. No. 2,465,319 and having a melt index of 208 and a density of 1.39 g/cm$^3$, was extruded at 262° C through a spinneret comprising two series of twenty-three orifices, each 0.23 mm in diameter. The spinning speed was about 12 m/min. A constant preorientation was produced by winding the resulting filaments at a winding speed of 1200 m/min (i.e., the winding speed was about 100 times the spinning speed).

The above preoriented yarn was subjected to an irregular drawing step by using a periodic effect generator as described in French patent 1,546,531 between two rolls that were about 35 cm apart. The periodic effect generator was a rotary disk turning at an average rate of 150 rpm and having a conical peg which served to guide the yarn. The original rate of the rotary disk was varied by ± 35 rpm, which corresponded to a yarn period length of 17 – 21 meters, to produce irregularly spaced thick and thin portions of the polybutylene terephthalate yarn. After the irregular drawing step, the yarn was wound at a rate of 636 m/min with an average drawing of the yarn of 2.04 times its original length. The resulting yarn, having 46 filaments, had thick portions approximately 10 cm long, spaced about 1.5 to 3 cm apart. The yarn exhibited the following characteristics:

| Description | Thin Portions | Thick Portions |
|---|---|---|
| Titer dtex | 123 | 165 |
| load to rupture, grams | 299 | 265 |
| elongation at break percent | 66.4 | 177 |
| tensile strength g/tex | 24.4 | 16.1 |
| average Young's modulus g/tex | 230 | |

Example 2

The extrusion and preorientation of Example 1 was repeated using polybutylene terephthalate which was identical to that of Example 1. The preoriented yarn was then subjected to an irregular drawing step by means of a vertical periodic effect generator device. The vertical periodic effect generator device consisted of, in order of the yarn advance direction, a delivery roll having a peripheral speed of about 258 m/min, a pig-tail yarn guide, a "Foster" cam which imparted a reciprocating motion to the first pig-tailed yarn guide perpendicular with the path of the yarn with the amplitude of the reciprocating motion being 7 cm, a second pig-tailed yarn guide located 10 cm from the first pig-tailed yarn guide, a drawing roll having a peripheral speed of 472 m/min, and a winding device. The frequency of the reciprocating motion imparted by the Foster cam averaged 500 reciprocations per minute, and the reciprocations were randomized to obtain an irregular spacing of the thick portions of the yarn filaments. The reciprocating frequency varied by ± 25 percent, with the randomizing being continuously varied. The speed of the winding spindle was 6,140 rpm and the average degree of drawing was 1.83 times its original length.

The resulting yarn, 115 dtex/33 filaments, had thick portions averaging about 1 m apart. The yarn varied, from thin portion to thick portion, from about 90 to about 160 dtex. The thick portions of the yarn, which were disymetrical, were irregularly located on the yarn.

This yarn exhibited the following characteristics :

| | Thin Portions | Thick Portions |
|---|---|---|
| Tensile Strength, g/tex | 35 | 21 |
| Elongation at break, % | 39.4 | 139 |
| Young's Modulus, g/tex | 291 | 160 |
| Birefringence | 0.220 | 0.143 |
| Density | 1.2993 | 1.3111 |
| Degree of crystallization % | 25.3 | 49.3 |

Example 3

A polybutylene terephthalate which was identical to that used in Example 1 was extruded through two series of spinneret orifices each having a diameter of 0.34 mm. The yarn was preoriented using the same procedure as in Example 1 with the exception that the winding speed was 900 m/min, and the resulting yarn titer was 180 dtex.

The resulting preoriented yarn was then subjected to an irregular drawing step between a delivery roll and a drawing roll, which produced an average draw of the yarn of 2.04 times its original length. The delivery roll and the drawing roll were about 35 cm apart. A periodic effect generator identical to that used in Example 1 was located between the rolls.

The resulting yarn had thick portions about 1.5 cm long, averaging about 208 cm apart, with the spacing between thick portions varying from 148 cm to 296 cm. The resulting yarn exhibited the characteristics set forth in the following table:

| | Titer, dtex | Elongation at Rupture % | Tensile Strength, g/tex |
|---|---|---|---|
| Average | 94/34 | | |
| Minimum | 51.1 | 39.5 | 26.2 |
| Maximum | 164.4 | 69.2 | 21.8 |
| | | Thick Portions | Thin Portions |
| Birefringence | | 0.110 | 0.190 |
| Average Youug's Modulus, g/tex | | 175 | 238 |

Example 4

The same polymer as in example 1 was extruded at 262°C through a spinneret comprising two series of 15 orifices, each 0.40 mm in diameter and a yarn was produced with a wind-up speed of 1200 m/min and an orientation factor of 127 (i.e. the ratio wind-up speed-/extrusion speed).

The above preoriented yarn was subjected to an irregular drawing step by using a periodic effect generator as described in French patent 1,546,531, between two rolls that were about 61 cm apart. The periodic effect generator was a rotary disk turning at a rate of 450 ± 120 rpm and having two diametrically opposed diabolos. Yarn was taken by one of the two diabolos and allowed to follow its rotation and escaped when it was taken by the other diabolo and so on. The drawing roll peripheral speed was 630 m/min involving an average draw of 1.9 times its original length.

The resulting yarn having 167 dtex/30 filaments, exhibited the following characteristics :

| | Thin Portions | Thick Portions |
|---|---|---|
| Titer, dtex | 131 | 282 |
| Tensile strength, g/tex | 40 | 16 |
| Elongation at break, % | 23 | 191 |
| Young's Modulus, g/tex | 210 | |
| Birefringence | 0.208 | 0.126 |
| Density | 1.3018 | 1.3083 |
| Degree of crystallization % | 27.95 | 35.15 |

Example 5

The same polymer as example 1 was extruded at 262°C through a spinneret comprising two series of 33 orifices, each 0.23 mm in diameter and two yarns were produced with a wind-up speed of 1200 m/min and an orientation factor of 81.

The above preoriented yarns were subjected to an irregular drawing step at room temperature between two rolls that were about 61 cm apart by using a periodic effect generator as described in FIG. 1 of French Patent 1,546,531. The periodic effect generator was a rotary disk turning at a rate of 150 ± 35 rpm and having a conical peg which served to guide the yarn. The yarn was wound at a rate of 620 m/min with an average drawing of the yarn of 2.0 times its original length.

The resulting yarn, having 100 dtex/33 filaments, exhibited the following characteristics :

| | Thin Portions | Thick Portions |
|---|---|---|
| Titer, dtex | 91.6 | 160 |
| Tensile Strength, g/tex | 33 | 19 |
| Elongation at break, % | 42 | 196 |
| Young's Modulus, g/tex | 269 | |
| Birefringence | 0.192 | 0.166 |
| Density | 1.2993 | 1.3028 |
| Degree of crystallization % | 25.3 | 29.1 |

It can be seen that the degrees of crystallization are very closed to each other in thin and thick parts of this yarn.

This yarn was subjected for 5 minutes at 210°C with dry heat, and then for 15 minutes in steam at 130°C. This treatment intends to reproduce the most severe conditions the yarn could be subjected to during dyeing or further handling, dyeing being usually effected nearly at 100°C.

Then, the yarn exhibited the following characteristics:

| | Thin Portions | Thick Portions |
|---|---|---|
| Titer, dtex | 106 | 180 |
| Tensile Strength, g/tex | 31 | 15 |
| Elongation at break % | 53 | 178 |
| Young's Modulus, g/tex | 207 | |

As a matter of comparison, a polyethyleneterephthalate was extruded through the same spinneret with a wind-up speed of 900 m/min and with an orientation factor of 55. The resulting yarn is subjected to an irregular drawing with the same apparatus as above, the disk as rotating at the same speed. The drawing roll peripheral speed was 400 m/min involving an average draw of 3.4 times its original length.

The resulting yarn exhibited the following characteristics :

| | Thin Portions | Thick Portions |
|---|---|---|
| Titer, dtex | 65 | 150 |
| Tensile strength, g/tex | 38.4 | 14.2 |
| Elongation at break, % | 31.8 | 323 |

This 323 % elongation for thick portions makes the yarn useless for textile. If the yarn was dyed, thick portions decomposed and yarn broke.

What is claimed is:

1. Polyester yarn consisting essentially of at least one oriented polybutylene terephthalate filament, said filament of irregular diameter, having thick portions and thin portions, the thick portions being of at least 20% greater diameter than the thin portions, said filament having substantially constant crystallinity over its whole length and an average Young's modulus below 300 g/tex, and having thick portions of about 1 to about 5 meters apart, said thick portions being of about 2 mm to about 150 cm long.

2. The yarn as claimed in claim 1, wherein said thick portions are of no more than 50% greater diameter than said thin portions.

* * * * *